United States Patent [19]

Siragusa

[11] 4,202,054

[45] May 13, 1980

[54] COLLAR CONSTRUCTION

[76] Inventor: Epifanio A. Siragusa, 519 Montauk Ave., New London, Conn. 06320

[21] Appl. No.: 925,426

[22] Filed: Jul. 17, 1978

[51] Int. Cl.[2] ..... A41B 1/00

[52] U.S. Cl. ..... 2/116

[58] Field of Search ..... 2/116, 129, 108, 115, 2/98, 100

[56] References Cited

U.S. PATENT DOCUMENTS

| | | | |
|---|---|---|---|
| 552,619 | 1/1896 | Pine | 2/129 |
| 2,385,729 | 9/1945 | Powell | 2/116 |
| 3,224,011 | 12/1965 | Lesavoy | 2/116 |

*Primary Examiner*—Doris L. Troutman

*Attorney, Agent, or Firm*—Auslander & Thomas

[57] ABSTRACT

This disclosure relates to a collar construction which is adapted to be secured to the neckline of a garment such as a shirt, sportshirt or the like. The collar comprises an elongated panel which includes pointed wings at opposite ends thereof, a free marginal edge and a connecting edge extended between said pointed wings. The connecting marginal edge is adapted to be secured to said garment. Furthermore, the collar includes a pair of slits, spaced apart from each other and symmetrically arranged along the elongated panel with respect to the middle portion thereof. A central inner rear portion is defined between the slits, whereby the pointed wings being movable independently one from the other and from the inner rear portion of the panel, particularly when the collar is used in an open fashion over the lapels of the collar of a jacket, while the inner rear portion will be partially hidden by the collar of said jacket encircling the wearer's neck.

7 Claims, 5 Drawing Figures

FIG.2
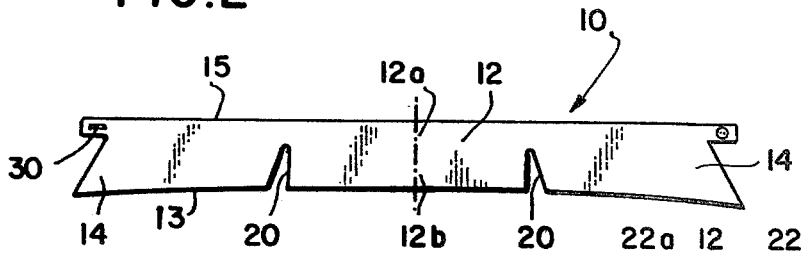
FIG.3
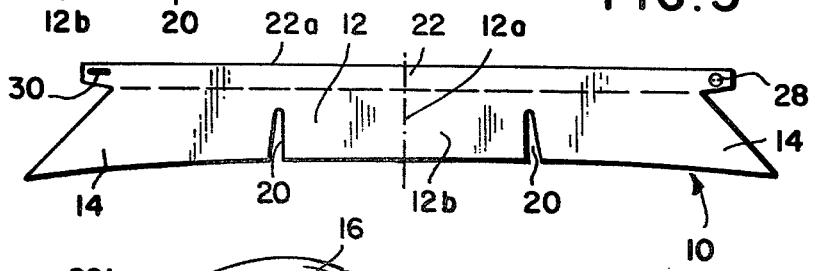
FIG.1
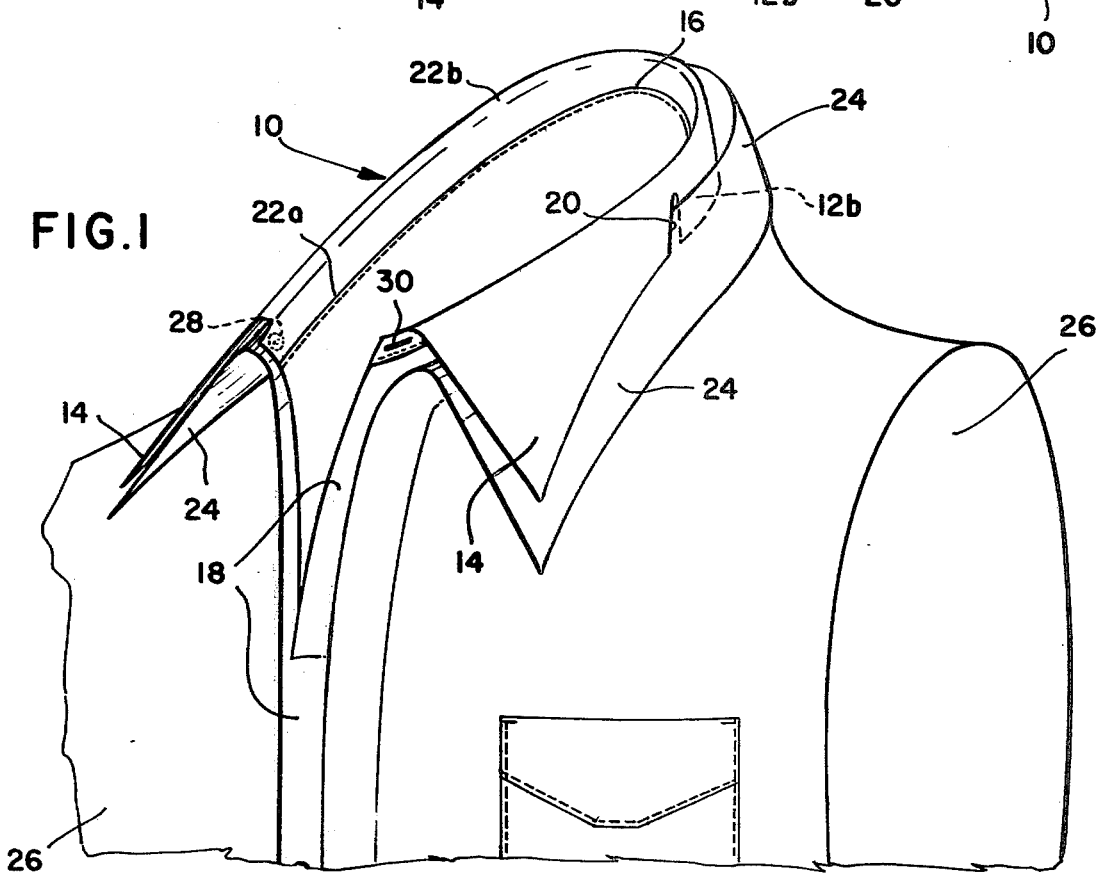
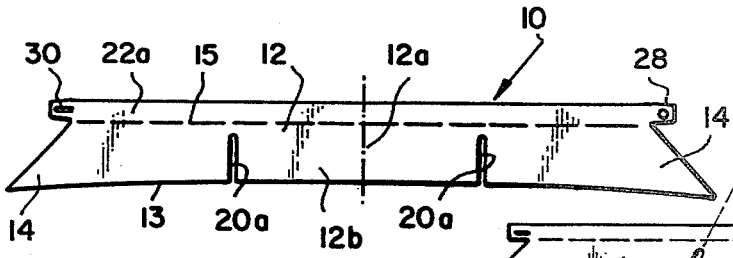
FIG.4
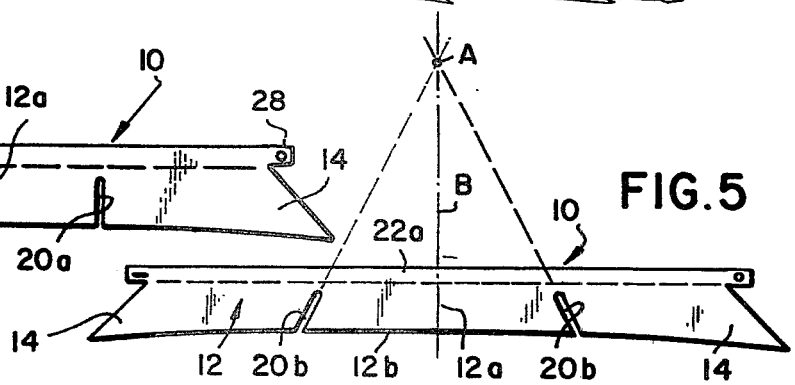
FIG.5

COLLAR CONSTRUCTION

The present invention relates to improvements in collar construction, and more specifically to a garment provided with a collar which may be used indifferently, depending upon the occasion, as an open sport collar such as in a continental fashion, or as an ordinary closed collar such as in a dress shirt.

All kinds of collars have been known in the art for many years. Thus, for instance, U.S. Pat. No. 978,738 shows a collar detachably connected to the neck band of a shirt having a band with a plurality of extensions or tongues projecting downwardly from the lower edge thereof throughout the length of the same to maintain the collar in a proper position on the neck of the wearer and to prevent the coat collar from working its way between the collar and the band of the neck of a shirt.

U.S. Pat. No. 1,116,988 discloses a collar adapted to be used as an ordinary collar or as a folded collar which includes an integral flap having a plurality of notches which allows the collar to be easily ironed flat and to facilitate the easy adjustment of the tie.

U.S. Pat. No. 1,159,761 teaches a fold-over collar comprising an outer substantially smooth, imperforated surface and an inner surface encircling the neck of the wearer, said inner surface including a plurality of cutsaway beneath the folded portion thereof to prevent bunching of the material.

U.S. Pat. No. 1,691,856 discloses a collar having stiffening or reinforcing inner triangular tabs arranged along the inner folded part of the collar so that the tie can be passed in a very simple manner through the folded part of the collar assuring the proper position of the tie with respect to the collar.

U.S. Pat. No. 2,436,696 shows a collar comprising a top portion, a band portion and an inner lining for the top and band, to increase the stiffness of the collar. The inner lining includes notches to facilitate the form of the collar around the neck of the wearer.

It is an object of this invention to provide a collar which may be used in combination with a garment in a continental fashion when it is used open over a front portion of the lapels of the collar of a jacket, or as in a dress shirt in a very formal fashion when it is used inside the jacket.

A further object of the instant invention is to improve the general appearance of the collar of a shirt, particularly when it is used over the lapels of a jacket in a sport fashion by having the pointed wings of the collar lying substantially flat onto the front portion of the lapels of a jacket without disturbing the back portion of the collar encircling the neck of the wearer in such a way that no wrinkles or bulky crests are formed thereon.

The foregoing objects are obtained in accordance with the present invention by providing a collar which is adapted to be secured to the neckline of a garment such as a shirt, sportshirt or the like, comprising an elongated panel having pointed portions or wings at opposite ends thereof; a free marginal edge and a connecting marginal edge extended between the pointed wings, the connecting marginal edge being secured to the neckline of the garment and a pair of slits or notches spaced apart from each other and symmetrically arranged along the elongated panel with respect to the middle portion thereof.

Due to the arrangement of the slits, on the lower portion of the panel extending from the free marginal edge and terminating near the connecting marginal edge, the pointed wings are able to move freely and independently from each other and from a central inner portion of the panel defined between said slits. Thereupon, the shirt, including the collar, designed in accordance with the present invention, may be used in a sport fashion with its collar open, lying only onto a portion of the lapels of a jacket without disturbing the central inner portion of the panel which will be partially hidden by the collar of the jacket.

Although such novel feature or features believed to be characteristic of the invention are pointed out in the claims, the invention and the manner in which it may be carried out, may be further understood by reference to the description following and the accompanying drawings.

FIG. 1 illustrates a perspective view of a garment, such as a shirt incorporating the collar of the present invention.

FIG. 2 shows a plan view of an elongated panel from which the collar in accordance with the present invention may be constructed.

FIG. 3 is a plan view of another elongated panel from which an alternative embodiment of the invention may be constructed.

FIG. 4 and FIG. 5 show different types of notches used in accordance with an alternative embodiments of the present invention.

Referring now to the figures in greater detail, where like reference numbers denote like parts in the various figures.

In FIG. 2, can be seen a collar 10 which may be constructed from an elongated panel 12 having pointed portions or wings 14 at opposite ends thereof. The elongated panel 12 further includes a free marginal edge 13 and a connecting marginal edge 15 extended between the pointed wings 14 in such a way that the connecting marginal edge 15 is adapted to be secured to the neckline 16 of a garment 18.

Furthermore, panel 12 includes a pair of slits or notches 20, which are spaced apart from each other, and symmetrically arranged with respect to the middle portion of the panel indicated at **12*a*, whereby a central inner portion 12*b* of the panel is defined between the notches or slits 20 which will be partially hidden by a back portion of the collar 24 of a jacket 26** encircling the neck of the wearer whether or not the garment is used as a dress shirt inside the jacket or a sport shirt with the collar open, as best shown in FIG. 1.

Due to the arrangement of the notches 20 extending from the free marginal edge 13 and terminating adjacent the connecting marginal edge 15, wings 14 are adapted to move independently from each other and from the central inner portion **12*b*, and therefore, the general appearance of the collar 10 is not disturbed when the garment or shirt 18 is used in a sport fashion with its collar open, lying partially flat onto the front portion of the lapels of the jacket 26**, since no wrinkles or bulky crests are formed thereon.

On the contrary, when shirt 18 is used as a dress shirt wearing its collar 10 inside the jacket 26, notches 20 are substantially hidden by the lapel 24 of the jacket 26 whereby the appearance of the shirt 18 is not distorted or modified.

FIGS. 4 and 5 show different types of notches preformed on the lower portion of the panel 12. Thus, for instance in FIG. 4, are illustrated notches **20*a* arranged parallel to each other while FIG. 5 shows a pair of notches 20***b* which converge to an imaginary point A located along the vertical axis B which passes along the middle portion 12*a* of the panel 12.

Panel 12 may include a neck band 22 having a connecting marginal edge 22*a* adapted to be secured at the neckline 16 of a garment 18, such as it has been shown in FIG. 1 of the drawings, and being able to fold over to define an upper folded edge 22*b* encircling the wearer's neck. Band 22 may include connecting means such as a button 28 and a button hole 30 at opposite ends thereof.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A collar adapted to be used in a garment such as a shirt sport shirt, or the like, comprising: an elongated panel having pointed front portions at opposite ends thereof, said panel including a free marginal edge and a connecting marginal edge extended between said pointed portions, said connecting marginal edge being adapted to be secured at the neckline of said garment, a plurality of slits spaced apart from each other, each slit extending from the free marignal edge and ending close to said connecting marginal edge, and a central inner rear portion extended substantially between said slits whereby said pointed portions being movable independently from each other and from said central inner rear portion without disturbing the overall appearance of the collar when the latter is used as an open sport collar over the lapels of the wearer's jacket.

2. The invention as claimed in claim 1 wherein said slits are symmetrically arranged with respect to a middle portion of said elongated panel, whereby said central inner rear portion will substantially encircle the back portion of the wearer's neck.

3. The invention as claimed in claim 1 wherein said slits are parallel to each other and substantially located at each side of the wearer's neck.

4. The invention as claimed in claim 2 wherein said slits converge to an imaginary point located within a vertical line passing through the middle portion of said elongated panel.

5. The invention as claimed in claim 1 wherein each slit has a triangular configuration having at least one apex close to said connecting marginal edge.

6. The invention as claimed in claim 1 wherein said pointed front portions constitute the wings of the collar adapted to lie flat onto a jacket's lapel in an open collar fashion, while said central inner rear portion thereof will be partially hidden by the collar of said jacket encircling the wearer's neck.

7. The invention as claimed in claim 1 further includes a continuous elongated band having connecting means at opposite ends thereof, said band being adapted to be secured to the neckline of said garment and folded over longitudinally to define an upper folded edge of said collar encircling the wearer's neck, said slits extending from the free marginal edge of the collar to a position adjacent said upper folded edge thereof, whereby said pointed portions being movable independently from each other and from said central inner rear portion, when the collar is used open and the pointed portions are adapted to lie flat onto the lapels of a jacket worn by the wearer.

* * * * *